US010941787B2

(12) United States Patent
Sakai et al.

(10) Patent No.: US 10,941,787 B2
(45) Date of Patent: Mar. 9, 2021

(54) POWER SOURCE INTEGRATED VACUUM PUMP HAVING A POWER SOURCE WITH A SUBSTRATE IN CONTACT WITH AND COVERING A PORTION OF A COOLING SURFACE WHICH IS ALSO COVERED BY A HEAT INSULATING PLATE

(71) Applicant: SHIMADZU CORPORATION, Kyoto (JP)

(72) Inventors: Haruhiko Sakai, Kyoto (JP); Nobuhiko Moriyama, Kyoto (JP)

(73) Assignee: SHIMADZU CORPORATION, Kyoto (JP)

( * ) Notice: Subject to any disclaimer, the term of this patent is extended or adjusted under 35 U.S.C. 154(b) by 197 days.

(21) Appl. No.: 15/948,735

(22) Filed: Apr. 9, 2018

(65) Prior Publication Data

US 2018/0306204 A1 Oct. 25, 2018

(30) Foreign Application Priority Data

Apr. 25, 2017 (JP) ..... JP2017-086416

(51) Int. Cl.
*F04D 29/58* (2006.01)
*F04D 19/04* (2006.01)
*F04D 25/06* (2006.01)

(52) U.S. Cl.
CPC ..... *F04D 29/5813* (2013.01); *F04D 19/042* (2013.01); *F04D 25/0606* (2013.01)

(58) Field of Classification Search
CPC ..... H05K 7/20218; H05K 7/20254; H05K 1/0201–0203; H05K 7/020218;
(Continued)

(56) References Cited

U.S. PATENT DOCUMENTS 5,121,292 A * 6/1992 Bell ..... H05K 7/20372 174/15.4
5,574,627 A * 11/1996 Porter ..... H01L 23/473 165/104.24
(Continued)

FOREIGN PATENT DOCUMENTS

CN 102782331 A 11/2012
JP 2006090251 A 4/2006
(Continued)

OTHER PUBLICATIONS

Office Action for corresponding CN Application No. 2018102006335 dated Aug. 14, 2019, with English language translation.
(Continued)

*Primary Examiner* — Patrick Hamo
*Assistant Examiner* — Benjamin Doyle
(74) *Attorney, Agent, or Firm* — Renner, Otto, Boisselle & Sklar, LLP

(57) ABSTRACT

A power source integrated vacuum pump configured such that a pump main body and a pump power source device are integrated together, comprises: a substrate which is provided at the pump power source device and on which an electronic component is mounted; a cooling device having a cooling surface fixed in contact with the substrate; and a heat insulating member having a smaller coefficient of thermal conductivity than that of a material forming the cooling surface and covering a cooling surface region to which the substrate is not fixed.

5 Claims, 3 Drawing Sheets

(58) Field of Classification Search
CPC ..... H05K 7/20509; H05K 7/20636; H05K 7/20772; F04D 19/042; F04D 25/0606; F04D 29/058; F04D 29/5813; F04D 29/5806; F04D 25/06; F04D 19/044
USPC ..... 417/723.8, 373, 423.4; 361/699, 702, 361/719–720
See application file for complete search history.

(56) References Cited

U.S. PATENT DOCUMENTS 5,971,725 A * 10/1999 de Simon ..... F04D 19/04 417/423.1
6,991,439 B2 * 1/2006 Ishikawa ..... F04D 29/5853 417/423.4
8,182,661 B2 * 5/2012 Tanase ..... C23C 14/3407 204/298.09
8,369,090 B2 * 2/2013 Chester ..... H05K 7/20772 361/699
8,961,105 B2 * 2/2015 Kogame ..... F04D 19/042 415/213.1
9,353,755 B2 * 5/2016 Nagano ..... F04D 19/042
9,964,112 B2 * 5/2018 Yamato ..... F04D 19/042
10,233,943 B2 * 3/2019 Moriyama ..... F04D 29/5813
2002/0131877 A1 * 9/2002 Omori ..... F04D 19/042 417/353
2010/0247350 A1 * 9/2010 Nagano ..... F04B 35/045 417/410.1
2013/0189089 A1 * 7/2013 Schroder ..... F04D 19/042 415/182.1
2015/0219116 A1 * 8/2015 Tsutsui ..... F04D 19/042 415/175
2016/0128238 A1 * 5/2016 Shedd ..... F25B 23/006 361/679.47
2017/0227018 A1 * 8/2017 Moriyama ..... F04D 29/584
2018/0283400 A1 * 10/2018 Tsubokawa ..... F04D 19/044
2019/0120237 A1 * 4/2019 Shiba ..... F04D 19/044
2019/0242386 A1 * 8/2019 Shimizu ..... F04D 19/04

FOREIGN PATENT DOCUMENTS

JP 2011158241 A 8/2011
JP 2014029129 A 2/2014
JP 2014-148977 A 8/2014
JP 2015105602 A 6/2015

OTHER PUBLICATIONS

Notice of Reasons for Refusal for corresponding JP Application No. 2017-086416 dated Jun. 26, 2020, with English language translation.
Notice of Reasons for Refusal for corresponding JP Application No. 2017-086416 dated Nov. 10, 2020, with English language translation.
Office Action for corresponding CN Application No. 2018102006335 dated Apr. 4, 2020, with English language translation.

* cited by examiner

POWER SOURCE INTEGRATED VACUUM PUMP HAVING A POWER SOURCE WITH A SUBSTRATE IN CONTACT WITH AND COVERING A PORTION OF A COOLING SURFACE WHICH IS ALSO COVERED BY A HEAT INSULATING PLATE

BACKGROUND OF THE INVENTION

1. Technical Field

The present invention relates to a power source integrated vacuum pump.

2. Background Art

A vacuum pump used for vacuum pumping of an external device such as a semiconductor manufacturing device includes a pump main body and a power source device configured to control the pump main body. A power source integrated vacuum pump configured such that a pump main body and a power source device are integrated together has been known (see, e.g., JP 2014-148977). In this pump, a cooling jacket configured such that coolant water circulates in the cooling jacket is provided between the pump main body and the power source device. A surface of the cooling jacket functions as a cooling surface. Of substrates provided at the power source device, a substrate on which an intensive-cooling requiring component requiring intensive cooling is mounted is fixed such that a substrate back surface contacts the surface of the cooling jacket.

Normally, the power source device has a semi-closed structure, and a dew point temperature in the power source device is the same as that outside the power source device, i.e., the temperature of external air. In the above-described power source integrated vacuum pump, when an exposed region to which no substrate is fixed is present at the cooling surface of the cooling jacket, the exposed region might reach a lower temperature than the dew point temperature, leading to dew condensation.

SUMMARY OF THE INVENTION

A power source integrated vacuum pump configured such that a pump main body and a pump power source device are integrated together, comprises: a substrate which is provided at the pump power source device and on which an electronic component is mounted; a cooling device having a cooling surface fixed in contact with the substrate; and a heat insulating member having a smaller coefficient of thermal conductivity than that of a material forming the cooling surface and covering a cooling surface region to which the substrate is not fixed.

The cooling device is a cooling jacket configured such that refrigerant circulates in the cooling jacket and arranged between the pump main body and the pump power source device, and the cooling surface is formed at a pump power source device side surface of the cooling jacket.

The heat insulating member is detachably provided on the cooling surface.

The cooling device is configured such that an optional circuit substrate can be fixed on the cooling surface region instead of detached heat insulating member.

The optional circuit substrate is an optional circuit substrate for communication or an optional substrate for an AC/DC circuit for three-system temperature adjustment.

The heat insulating member is made of a resin material, and the cooling surface is made of a metal material.

Percentage of total area where the substrate and the heat insulating member are fixed to the cooling surface relative to total area of the cooling surface is larger than 80.

According to the present invention, dew condensation on the cooling surface can be prevented.

DETAILED DESCRIPTION OF THE EXEMPLARY EMBODIMENTS

Figure 1:
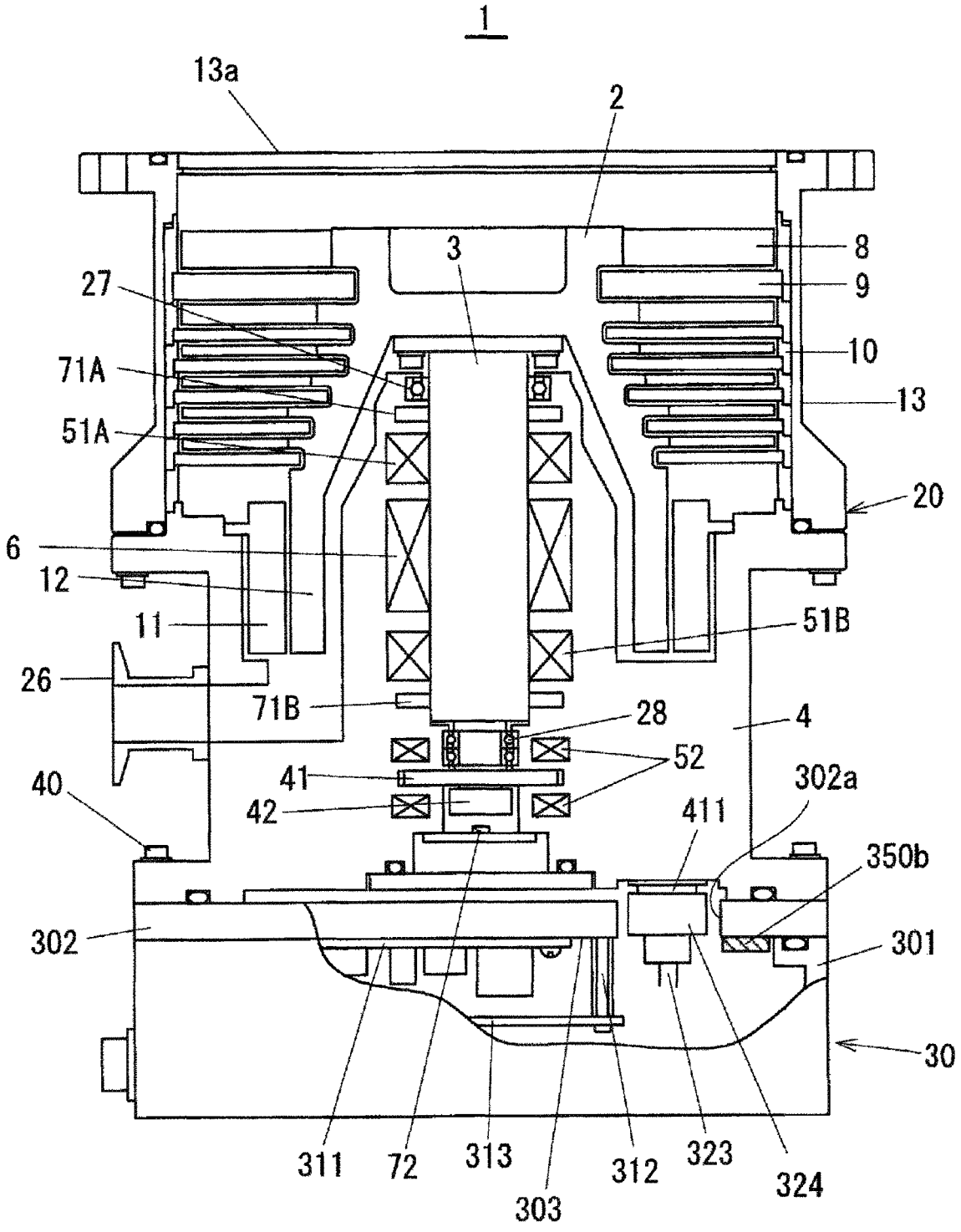
FIG. 1 is a sectional view of an outline configuration of a power source integrated vacuum pump.

Hereinafter, an embodiment of the present invention will be described with reference to the drawings. FIG. 1 is a sectional view of an outline configuration of a power source integrated vacuum pump 1. The power source integrated vacuum pump 1 illustrated in FIG. 1 is a magnetic bearing turbo-molecular pump, and is configured such that a pump unit 20 and a power source unit 30 are integrally fixed together with bolts 40.

In the pump unit 20, a shaft 3 attached to a rotor 2 is non-contact supported by magnetic bearings 51A, 51B, 52 provided at a pump base 4. A levitation position of the shaft 3 is detected by radial displacement sensors 71A, 71B and an axial displacement sensor 72 provided at the pump base 4. Note that in a state in which the magnetic bearings are not in operation, the shaft 3 is supported by mechanical bearings 27, 28.

A circular rotor disc 41 is provided at a lower end of the shaft 3, and electromagnets of the magnetic bearing 52 are provided to sandwich the rotor disc 41 in an upper-to-lower direction through a clearance. The rotor disc 41 is attracted by the magnetic bearing 52 such that the shaft 3 is levitated in an axial direction. The rotor disc 41 is fixed to a lower end portion of the shaft 3 with a nut member 42.

The rotor 2 is provided with multiple rotor blades 8 in a rotation axis direction. Each stationary blade 9 is arranged between adjacent ones of the rotor blades 8 arranged in the upper-to-lower direction. The rotor blades 8 and the stationary blades 9 form a turbine blade stage of the pump unit 20. Each stationary blade 9 is held with the stationary blade 9 being sandwiched between adjacent ones of spacers 10 in the upper-to-lower direction. The spacers 10 have the function of holding the stationary blades 9, as well as having the function of maintaining a gap between adjacent ones of the stationary blades 9 at a predetermined spacing.

A screw stator 11 forming a drag pump stage is provided at a subsequent stage (a lower side as viewed in the figure) of the stationary blades 9, and a gap is formed between an inner peripheral surface of the screw stator 11 and a cylindrical portion 12 of the rotor 2. The rotor 2 and the stationary blades 9 held by the spacers 10 are housed in a pump case 13 provided with a suction port 13*a*. When the shaft 3 attached to the rotor 2 is rotatably driven by a motor 6 with the shaft 3 being non-contact supported by the magnetic bearings 51A, 51B, 52, gas is exhausted from a suction port 13*a* side to a back pressure side, and the gas exhausted to the back pressure side is discharged by an auxiliary pump (not shown) connected to an exhaust port 26.

The power source unit 30 is bolted to a bottom surface side of the pump base 4 provided at the pump unit 20. The power source unit 30 configured to drivably control the pump unit 20 is provided with electronic components, the electronic components forming a main control section, a magnetic bearing drive control section, a motor drive control section, etc. These electronic components are housed in a housing of the power source unit 30.

The housing of the power source unit 30 includes a power source case 301 and a cooling jacket 302 covering an upper opening of the power source case 301. The cooling jacket 302 is provided with an opening 302*a*. A plug 324 of a cable 323 on a power source unit 30 side is connected to a receptacle 411 provided on a bottom surface of the pump base 4 through the opening 302*a*, and therefore, the power source unit 30 is connected to the pump unit 20.

Figure 2:
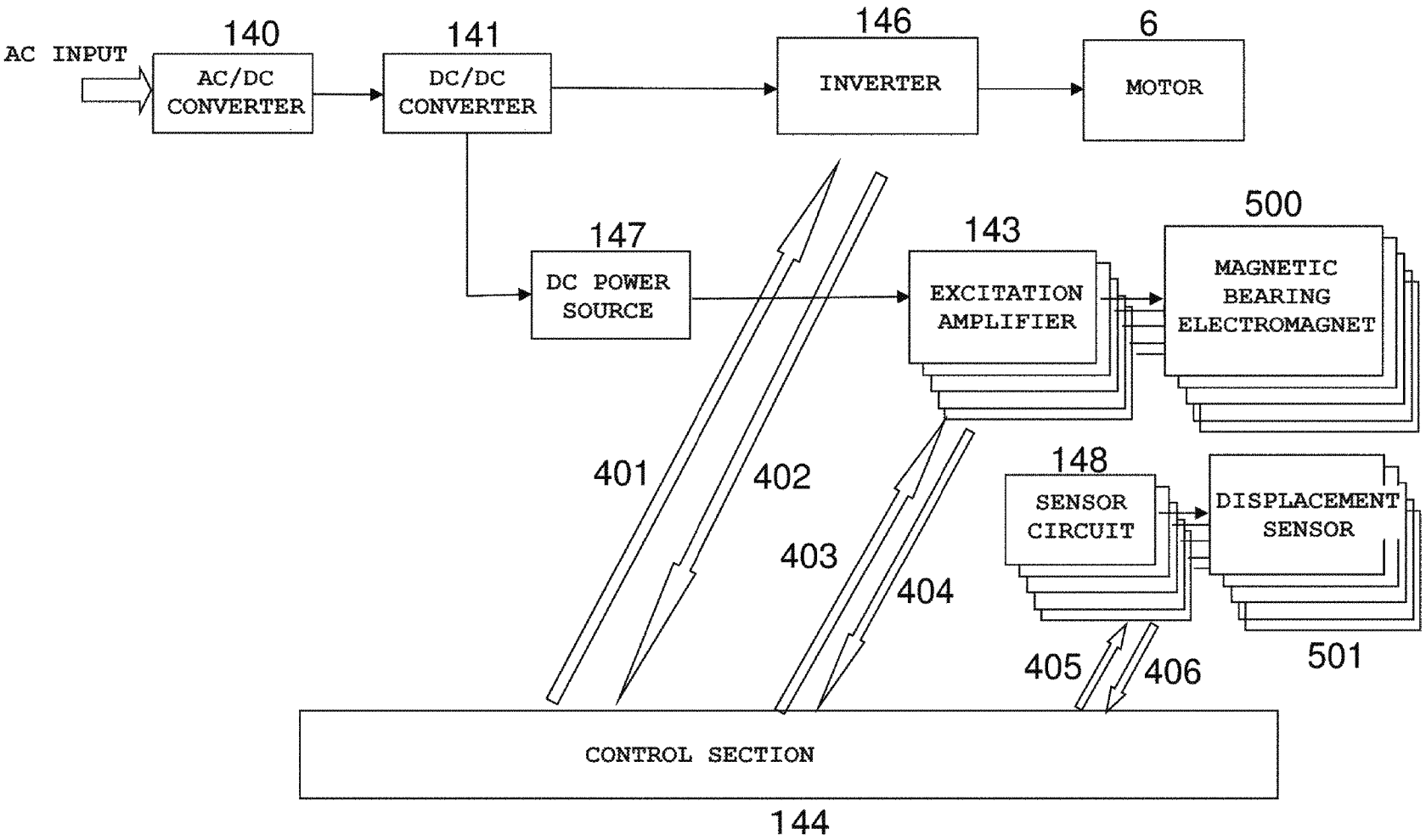
FIG. 2 is a block diagram of an outline configuration of a power source unit.

FIG. 2 is a block diagram of an outline configuration of the power source unit 30. AC input from the outside is converted into DC output (DC voltage) by an AC/DC converter 140 provided at the power source unit 30. The DC voltage output from the AC/DC converter 140 is input to a DC/DC converter 141, and then, DC voltage for the motor 6 and DC voltage for the magnetic bearings are generated by the DC/DC converter 141.

The DC voltage for the motor 6 is input to an inverter 146. The DC voltage for the magnetic bearings is input to a DC power source 147 for the magnetic bearings. The magnetic bearings 51A, 51B, 52 illustrated in FIG. 1 form a five-axis magnetic bearing. Each of the magnetic bearings 51A, 51B has two pairs of magnetic bearing electromagnets 500, and the magnetic bearing 52 has a pair of magnetic bearing electromagnets 500. Current is separately supplied from 10 excitation amplifiers 143 to the five pairs of magnetic bearing electromagnets 500, i.e., 10 magnetic bearing electromagnets 500, the excitation amplifiers 143 being each provided for the magnetic bearing electromagnets 500. Each of the radial displacement sensors 71A, 71B illustrated in FIG. 1 has two pairs of displacement sensors 501, and the axial displacement sensor 72 has a pair of displacement sensors 501. Sensor circuits 148 are each provided at the displacement sensors 501 in five pairs.

A control section 144 is a digital arithmetic unit configured to control the motor and the magnetic bearings, and a field programmable gate array (FPGA) is used as the control section 144 in the present embodiment. The control section 144 outputs, to the inverter 146, a PWM control signal 401 for controlling ON/OFF of multiple switching elements included in the inverter 146, and outputs, to each excitation amplifier 143, a PWM control signal 403 for controlling ON/OFF of a switching element included in the excitation amplifier 143. Further, a sensor carrier signal (a carrier signal) 405 is input from the control section 144 to each sensor circuit 148. In addition, signals 402 relating to phase voltage and phase current for the motor 6 and electromagnet current signals 404 relating to the magnetic bearings are input to the control section 144. Moreover, a sensor signal 406 modulated by rotor displacement is input from each sensor circuit 148.

As illustrated in FIG. 1, each electronic circuit in the power source unit 30 is mounted on a substrate 311 fixed to a cooling surface 303 of the cooling jacket 302 and a substrate 313 fixed to the cooling surface 303 through a support rod 312. An electronic circuit with a relatively-large amount of heat generation is mounted on the substrate 311, and an electronic circuit with a relatively-small amount of heat generation is mounted on the substrate 313. Of electronic circuits illustrated in the block diagram of FIG. 2, the magnetic bearing drive circuit including the AC/DC converter 140, the DC/DC converter 141, the DC power source 147, the excitation amplifiers 143, etc. and the inverter 146 are mounted on the substrate 311, and a control circuit including the control section 144 is mounted on the substrate 313, for example.

Figure 3:
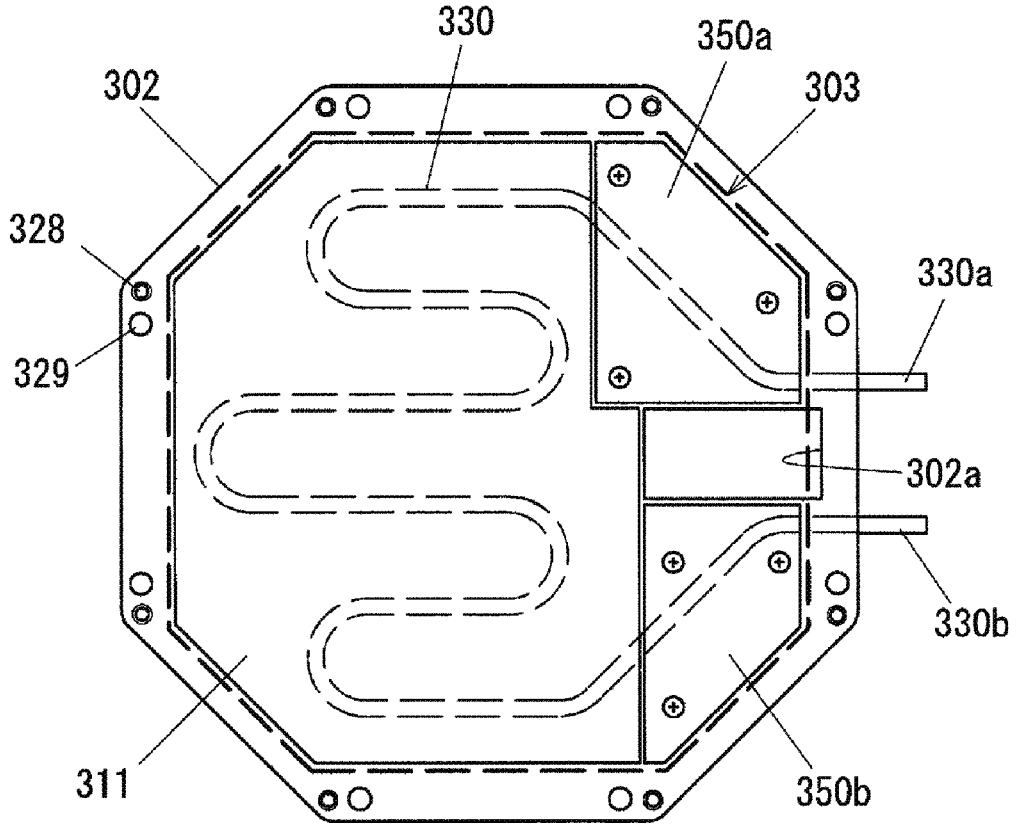
FIG. 3 is a view for describing a component arranged on a cooling surface of a cooling jacket.

FIG. 3 is a view for describing a component arranged on the cooling surface 303 of the cooling jacket 302, the view illustrating the cooling jacket 302 from the power source unit 30 side. Multiple through-holes 329 into which bolts for fixing the cooling jacket 302 to the power source case 301 are each inserted and multiple screw holes 328 for fixing the cooling jacket 302 to the pump base 4 with the bolts 40 (see FIG. 1) are formed at the cooling jacket 302.

The cooling jacket 302 is made of a metal material exhibiting excellent thermal conductivity, such as an aluminum material. The cooling jacket 302 includes a refrigerant passage 330 for circulating liquid refrigerant such as coolant water. In an example illustrated in FIG. 3, a metal pipe such as a copper pipe is casted into the cooling jacket 302, thereby forming the refrigerant passage 330. An inlet portion 330*a* and an outlet portion 330*b* of the metal pipe protrude from a right side surface of the cooling jacket 302 as viewed in the figure.

In FIG. 3, a jacket surface in a region of the cooling jacket 302 surrounded by a dashed line forms the cooling surface 303. The substrate 311 illustrated in FIG. 1 is fixed to cover a center portion and a left region of the cooling surface 303. On the other hand, no substrate on which the electronic components are mounted is fixed to a right region of the cooling surface 303 with respect to the substrate 311, and heat insulating members (hereinafter referred to as "heat insulating plates 350*a*, 350*b*") are screwed instead. For the heat insulating plates 350*a*, 350*b*, a material (e.g., a resin material) having a smaller coefficient of thermal conductivity than that of the cooling jacket 302 is used. For example, a polycarbonate or glass epoxy substrate is used. Percentage of total area where the substrate and the heat insulating member are fixed to the cooling surface relative to total area of the cooling surface is larger than 80.

(C1) As described above, the power source integrated vacuum pump 1 is a vacuum pump configured such that the pump unit 20 as a pump main body and the power source unit 30 as a pump power source device are integrated together. The power source integrated vacuum pump 1 includes the substrate 311 which is provided at the power source unit 30 and on which the electronic components are mounted, the cooling jacket 302 as a cooling device having the cooling surface 303 fixed in contact with the substrate 311, and the heat insulating plates 350*a*, 350*b* as heat insulating members having a smaller coefficient of thermal conductivity than that of the material forming the cooling surface 303 and covering the region of the cooling surface 303 to which the substrate 311 is not fixed.

The heat insulating plates 350*a*, 350*b* are provided on an exposed surface (i.e., the region of the cooling surface 303 to which the substrate 311 is not fixed) of the cooling surface 303 of which temperature has been decreased by refrigerant, thereby covering the exposed surface. Thus, a contact area between the cooling surface 303 and air is reduced. In the example illustrated in FIG. 3, almost no region contacting air remains in the cooling surface 303. The heat insulating plates 350*a*, 350*b* are made of the material having a smaller coefficient of thermal conductivity than that of the aluminum material forming the cooling surface 303, and for this reason, there is a difference between the cooling-surface-side temperature of the heat insulating plate 350*a*, 350*b* and the temperature of the surface contacting air. As a result, the surface temperatures of the heat insulating plates 350*a*, 350*b* can be maintained higher than the temperature of the cooling surface 303. This can prevent occurrence of dew condensation on the heat insulating plates 350*a*, 350*b*.

(C2) Further, the cooling device is configured as the cooling jacket 302 configured such that refrigerant circulates in the cooling jacket 302 and arranged between the pump unit 20 and the power source unit 30. This can prevent heat transfer from the pump unit 20 to the power source unit 30 or heat transfer from the power source unit 30 to the pump unit 20.

(C3) Further, the heat insulating plates 350*a*, 350*b* are screwed to the cooling surface 303 as illustrated in FIG. 3, and are detachably configured. Thus, even in a case where a circuit board is added or removed, exposure of the cooling surface 303 can be easily reduced.

For example, there is a case where some circuits are added or removed according to specifications of the power source unit 30. Of these circuits, an optional circuit for communication, an optional AC/DC circuit for three-system temperature adjustment, etc. are circuits with a great amount of heat generation, for example. Such optional circuits are fixed to the region where the heat insulating plates 350*a*, 350*b* of FIG. 3 are arranged. For example, a substrate on which the AC/DC circuit for three-system temperature adjustment is mounted is fixed to the region where the heat insulating plate 350*a* is arranged, and a substrate on which the circuit for communication is mounted is fixed to the region where the heat insulating plate 350*b* is arranged. That is, in the case of the power source unit 30 with specifications for mounting the AC/DC circuit for three-system temperature adjustment, the substrate on which the AC/DC circuit for three-system temperature adjustment is mounted is fixed instead of the heat insulating plate 350*a*, and the heat insulating plate 350*b* remains attached. As described above, the heat insulating plates 350*a*, 350*b* are detachably configured, and therefore, is easily applicable to the power source units 30 with multiple specifications.

Needless to say, the detachable heat insulating plates 350*a*, 350*b* as illustrated in FIG. 3 are not necessarily used as the heat insulating members covering the region of the cooling surface 303 to which no substrate is fixed. For example, a layer (e.g., a thick film) of a heat insulating material may be, for example, applied to the cooling surface region where no substrate is arranged. Even in the case of a single-specification power source instead of the above-described power source unit 30 for multiple specifications, when the area of the cooling surface 303 of the cooling jacket 302 is larger than the area of the substrate requiring direct cooling, the heat insulating layer may be, for example, applied to the cooling surface region where no substrate is provided.

The embodiment and the variations have been described above, but the present invention is not limited to these contents. Other aspects conceivable within the scope of the technical idea of the present invention are also included in the scope of the present invention. For example, in the above-described embodiment, the power source integrated vacuum pump configured such that the pump unit 20 is the turbo-molecular pump has been described by way of example, but the pump unit 20 is not limited to the turbo-molecular pump.

What is claimed is:

1. A power source integrated vacuum pump configured such that a pump main body and a pump power source device are integrated together, comprising:

a substrate which is provided at the pump power source device and on which an electronic component is mounted;

a cooling device having a cooling surface fixed in contact with the substrate, the cooling surface being formed at a pump power source device side surface of the cooling device; and a heat insulating plate having a smaller coefficient of thermal conductivity than that of a material forming the cooling surface and configured to cover a majority of a remainder of the cooling surface to which the substrate is not fixed, wherein a pump power source device side surface of the heat insulating plate is exposed in the pump power source device to prevent occurrence of dew condensation on the cooling surface.

2. The power source integrated vacuum pump according to claim 1, wherein the cooling device is a cooling jacket configured such that a refrigerant circulates in the cooling jacket and arranged between the pump main body and the pump power source device, and the cooling surface is formed at a pump power source device side surface of the cooling jacket.

3. The power source integrated vacuum pump according to claim 1, wherein the heat insulating plate is detachably provided on the cooling surface so as to be in either an attached or detached state.

4. The power source integrated vacuum pump according to claim 1, wherein the heat insulating plate is made of a resin material, and the cooling surface is made of a metal material.

5. The power source integrated vacuum pump according to claim 1, wherein a percentage of the total area of the cooling surface where the substrate and the heat insulating plate are fixed to the cooling surface relative to total area of the cooling surface is larger than 80.

* * * * *